US006053715A

United States Patent [19]

Hirano et al.

[11] Patent Number: 6,053,715

[45] Date of Patent: Apr. 25, 2000

[54] SCROLL TYPE COMPRESSOR

[75] Inventors: Hideo Hirano; Hiroyuki Kawano, both of Kusatsu; Hideto Oka, Kouka-gun; Masahiro Tsubokawa, Kusatsu, all of Japan

[73] Assignee: Matsushita Electric Industrial Co., Ltd., Osaka-Fu, Japan

[21] Appl. No.: 09/164,533

[22] Filed: Sep. 30, 1998

[30] Foreign Application Priority Data

Sep. 30, 1997 [JP] Japan ..... 9-266977
Sep. 30, 1997 [JP] Japan ..... 9-266978

[51] Int. Cl.[7] ..... F01C 1/02

[52] U.S. Cl. ..... 418/55.6; 418/97; 418/55.2; 418/181

[58] Field of Search ..... 418/55.6, 97, 55.2, 418/181

[56] References Cited

U.S. PATENT DOCUMENTS 4,927,341 5/1990 Bush ..... 418/55

FOREIGN PATENT DOCUMENTS 5240176 of 0000 Japan .
112794 5/1986 Japan ..... 418/55.6
57894 3/1991 Japan ..... 418/55.6
404203381 7/1992 Japan ..... 418/55.6

*Primary Examiner*—Thomas Denion
*Assistant Examiner*—Theresa Trieu
*Attorney, Agent, or Firm*—Price Gess & Ubell

[57] ABSTRACT

An orbiting scroll is engaged to and moved orbitally in relation to a fixed scroll at variable speeds. An offset surface is provided in at least one of the wraps of the fixed scroll and/or the orbiting scroll, by which a space S is created in one of the compression chambers formed between the fixed scroll and the orbiting scroll, which is thereby unsealed and opened to the inlet port side. The offset surface has a length from a position in the spiral length which satisfies the required compression ratio of one of the compression chambers in a low speed operation to the end of the spiral. An injection port is positioned such as to open to an unsealed area of this compression chamber, and gas injection shutoff and resumption is controlled through this injection port as appropriate to the situation.

16 Claims, 10 Drawing Sheets

51
15
14
12
11
11a
11b
12a
13A
13B
C
S
D
L1
L2
0°
30°
90°
150°
180°
210°
270°
330°

C
S
D
13A
13B
51
15
14
11
11a
11b
12
12a
0°
30°
90°
150°
180°
210°
270°
330°
V1
V2

0°
30°
90°
150°
180°
210°
270°
330°

0°
30°
90°
150°
180°
210°
270°
330°

0°
30°
90°
150°
180°
210°
270°
330°
S
D1
C1
51
13A
13B
15
14
C2
D2
11
11a
11b
12
12a
12b

SCROLL TYPE COMPRESSOR

BACKGROUND OF THE INVENTION

1. Field of the Invention

The present invention relates to a scroll type compressor that is principally used in refrigeration and air conditioning systems for commercial and residential use.

2. Description of Related Art

Several types of electrical compressors are used for refrigeration and air conditioning, including a reciprocating type, a rotary type, and a scroll type. Each of these types has been developed considering the special characteristics of each type along with the cost and performance of the type. Among these, the scroll type compressor, which exhibits high efficiency, low noise, and low vibration, has come to be widely used.

Japanese patent Laid-open No. Hei.5-240176 describes a scroll compressor that uses one injection port which is connected to two compression chambers to perform the gas injection, so that the amount of gas injected into each chamber is equal. By this method, it is possible to avoid both heat deformation of the scroll parts due to localized thermal imbalance and lubricant degradation.

However, the increasing requirement to have many operation modes has made it necessary to be able to control the rotation speed of the scroll compressor using an inverter controller or similar device, which will allow the compressor to reach its optimum operation state. Another requirement that has come to be made is that the compressor be able to shutoff or resume gas injection as appropriate to the situation.

In the cases of variable speed rotation and gas injection shutoff or resumption conditions, since the conventional compressor always has a fixed compression ratio, the efficiency in the case of low speed operation is limited. Furthermore, if the gas injection is shutoff, there will be some coolant gas in dead volume areas that include the check valve that is in the area surrounding the gas injection port. This coolant gas, after being compressed in the compression chamber during the compression stage, will re-expand after the next coolant is brought into the compression chamber to begin confinement. This will have a large effect on the low load operation where the rotation speed is low, decreasing the performance.

SUMMARY OF THE INVENTION

An object of the present invention is to provide a scroll type compressor that maintains efficiency in a low load operation state when the gas injection is shutoff, while at the same time operating efficiently with high gas injection under high load operation state at low injection pressure, which is needed for heating operations, for example. A further object of the present invention is to provide a scroll compressor with a larger control regime as mentioned above.

BRIEF DESCRIPTION OF THE DRAWINGS

FIGS. 3A–H show the change in the injection port opening position under the compression stage inside of the compression chamber in the compressor; in which FIG. 3A shows the rotation angle of 0°; FIG. 3B shows the state where the angle has advanced from the 0° position in FIG. 3A to the 30° position; FIG. 3C shows the state where the angle has advanced from the 30° position of FIG. 3B to the 90° position; FIG. 3D shows the state where the angle has advanced from the 90° position of FIG. 3C to the 150° position; FIG. 3E shows the state where the angle has advanced from the 150° position of FIG. 3D to the 180° position; FIG. 3F shows the state where the angle has advanced from the 180° position of FIG. 3E to the 210° position; FIG. 3G shows the state where the angle has advanced from the 210° position of FIG. 3F to the 270° position; and FIG. 3H shows the state where the angle has advanced from the 270° position of FIG. 3G to the 330° position;

FIGS. 5A–H show the change in the injection port opening position under the compression stage inside of the compression chamber in the compressor according to a second embodiment of the present invention; in which FIG. 5A shows the rotation angle of 0°; FIG. 5B shows the state where the angle has advanced from the 0° position in FIG. 5A to the 30° position; FIG. 5C shows the state where the angle has advanced from the 30° position of FIG. 5B to the 90° position; FIG. 5D shows the state where the angle has advanced from the 90° position of FIG. 5C to the 150° position; FIG. 5E shows the state where the angle has advanced from the 150° position of FIG. 5D to the 180° position; FIG. 5F shows the state where the angle has advanced from the 180° position of FIG. 5E to the 210° position; FIG. 5G shows the state where the angle has advanced from the 210° position of FIG. 5F to the 270° position; and FIG. 5H shows the state where the angle has advanced from the 270° position of FIG. 5G to the 330° position;

FIGS. 6A–H show the change of the injection port opening position under the compression stage inside of the compression chamber in the compressor according to a third embodiment of the present invention; in which FIG. 6A shows the rotation angle of 0°; FIG. 6B shows the state where the angle has advanced from the 0° position in FIG. 6A to the 30° position; FIG. 6C shows the state where the angle has advanced from the 30° position of FIG. 6B to the 90° position; FIG. 6D shows the state where the angle has advanced from the 90° position of FIG. 6C to the 150° position; FIG. 6E shows the state where the angle has advanced from the 150° position of FIG. 6D to the 180° position; FIG. 6F shows the state where the angle has advanced from the 180° position of FIG. 6E to the 210° position; FIG. 6G shows the state where the angle has advanced from the 210° position of FIG. 6F to the 270° position; and FIG. 6H shows the state where the angle has advanced from the 270° position of FIG. 6G to the 330° position;

FIGS. 8A–H show the change of the injection port opening position under the compression stage inside of the compression chamber in the compressor according to a fourth embodiment of the present invention; in which FIG. 8A shows the rotation angle of 0°; FIG. 8B shows the state where the angle has advanced from the 0° position in FIG.

8A to the 30° position; FIG. 8C shows the state where the angle has advanced from the 30° position of FIG. 8B to the 90° position; FIG. 8D shows the state where the angle has advanced from the 90° position of FIG. 8C to the 150° position; FIG. 8E shows the state where the angle has advance from the 150° position of FIG. 8D to the 180° position; FIG. 8F shows the state where the angle has advanced from the 180° position of FIG. 8E to the 210° position; FIG. 8G shows the state where the angle has advanced from the 210° position of FIG. 8F to the 270° position; and FIG. 8H shows the state where the angle has advanced from the 270° position of FIG. 8G to the 330° position;

FIGS. 10A–H show the change of the injection port opening position under the compression stage inside of the compression chamber in the compressor according to a fifth embodiment of the present invention; in which FIG. 10A shows the rotation angle of 0°; FIG. 10B shows the state where the angle has advanced from the 0° position in FIG. 10A to the 30° position; FIG. 10C shows the state where the angle has advanced from the 30° position of FIG. 10B to the 90° position; FIG. 10D shows the state where the angle has advanced from the 90° position of FIG. 10C to the 150° position; FIG. 10E shows the state where the angle has advanced from the 150° position of FIG. 10D to the 180° position; FIG. 10F shows the state where the angle has advanced from the 180° position of FIG. 10E to the 210° position; FIG. 10G shows the state where the angle has advanced from the 210° position of FIG. 10F to the 270° position; and FIG. 10H shows the state where the angle has advanced from the 270° position of FIG. 10G to the 330° position.

DESCRIPTION OF THE PREFERRED EMBODIMENTS

Below several preferred embodiments of the present invention are explained in detail with reference to FIGS. 1–10.

(Embodiment 1)

Figure 1:
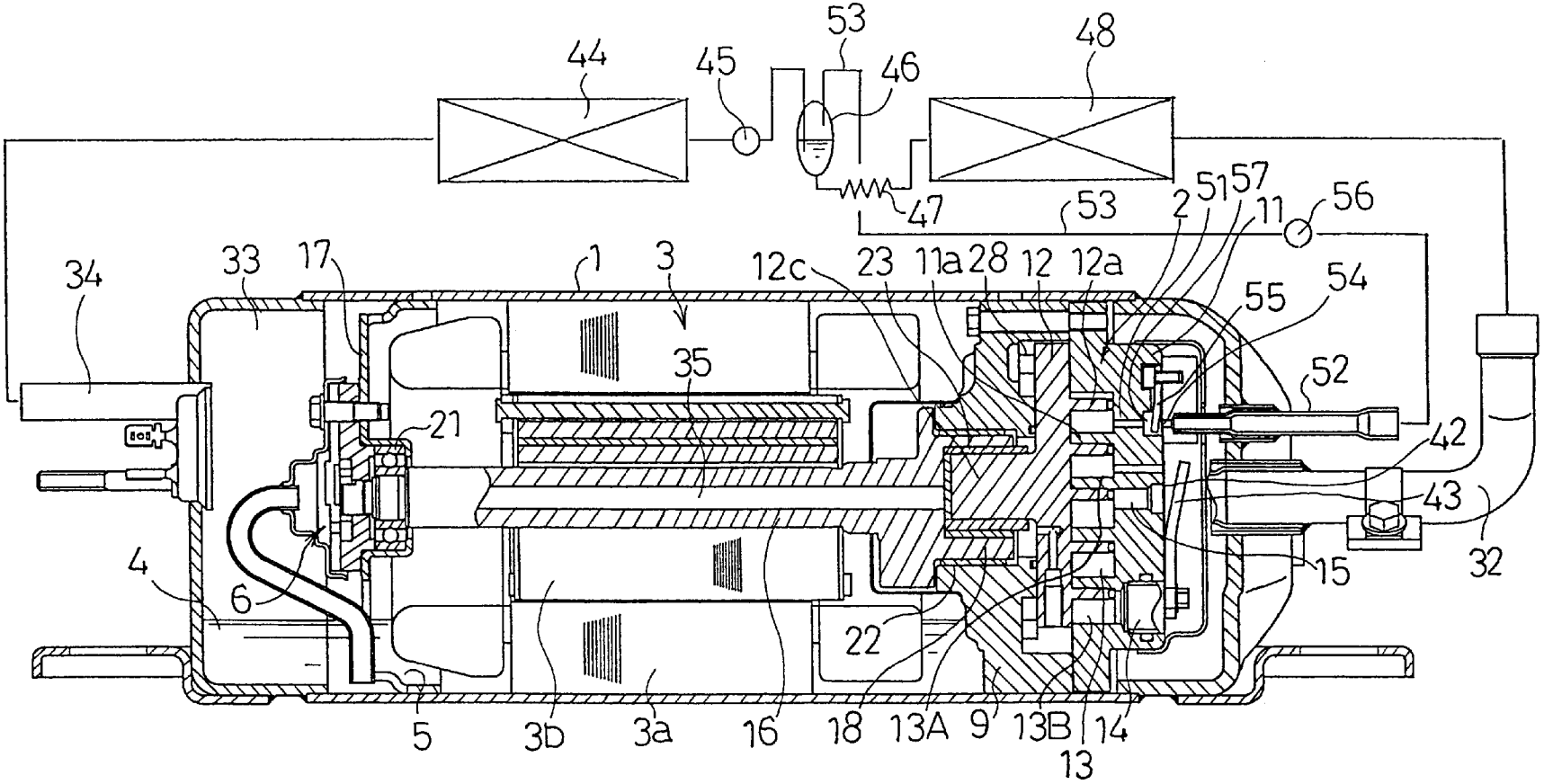
FIG. 1 is a longitudinal cross-sectional view showing a scroll compressor according to a first embodiment of the present invention.

FIG. 1 illustrates the complete structure of Embodiment 1, a horizontal style scroll type compressor used for refrigeration and air conditioning.

The scroll style compressor mechanism is mounted on one side of the sealed housing 1. In the center of the sealed housing 1, the electrical motor 3 that is used to power the compressor mechanism 2 is installed. On the other side of the sealed housing 1, there is an oil pump 6 that is used to transport oil 4 to the components to be lubricated. The oil 4 is stored in the oil storage container 5 located on the bottom part of the sealed housing 1.

Figure 2:
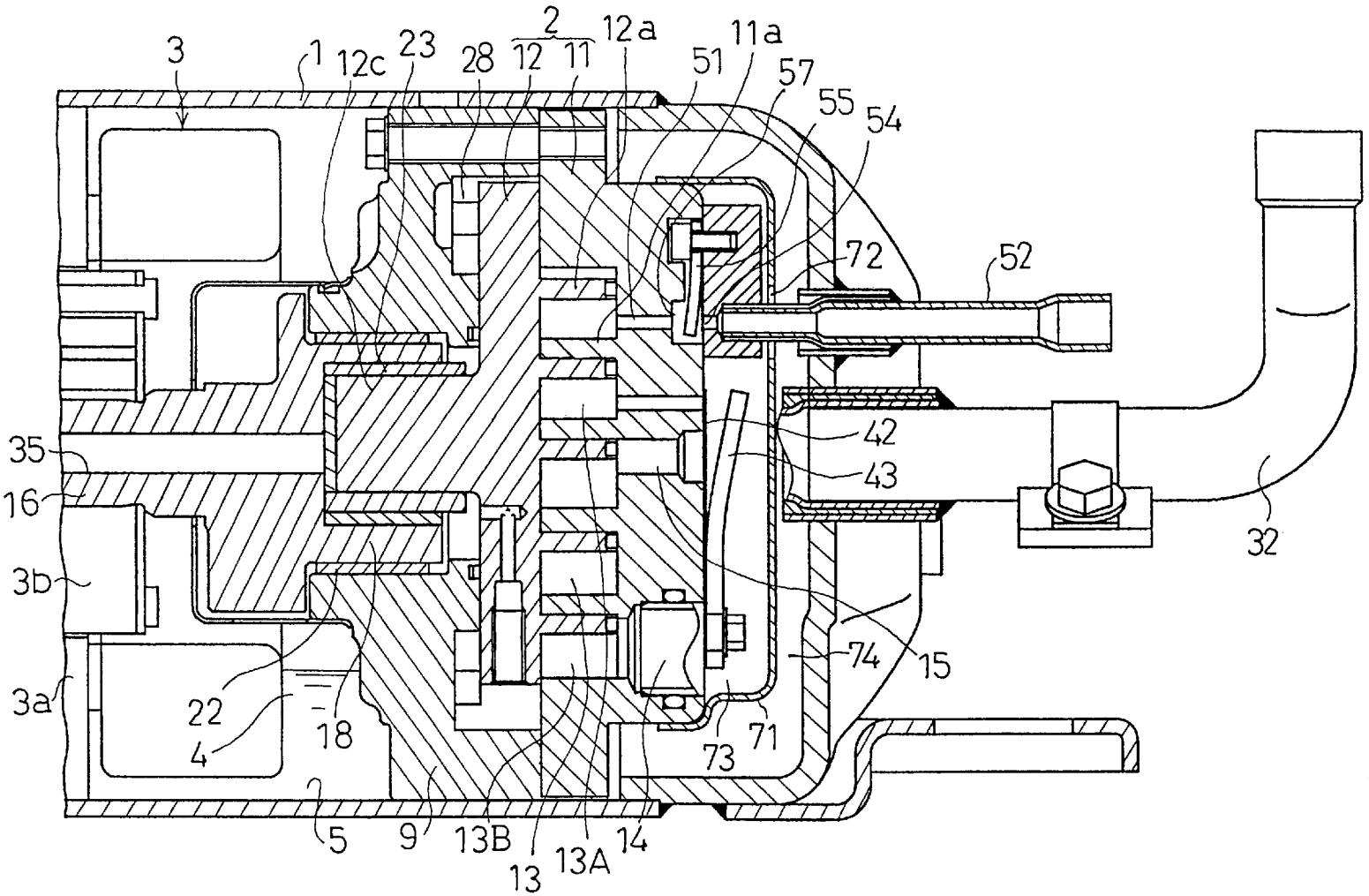
FIG. 2 is a cross-sectional view of a main part of the compressor.
Figures 3A, 3B, 3C, 3D, 3E, 3F, 3G, 3H:
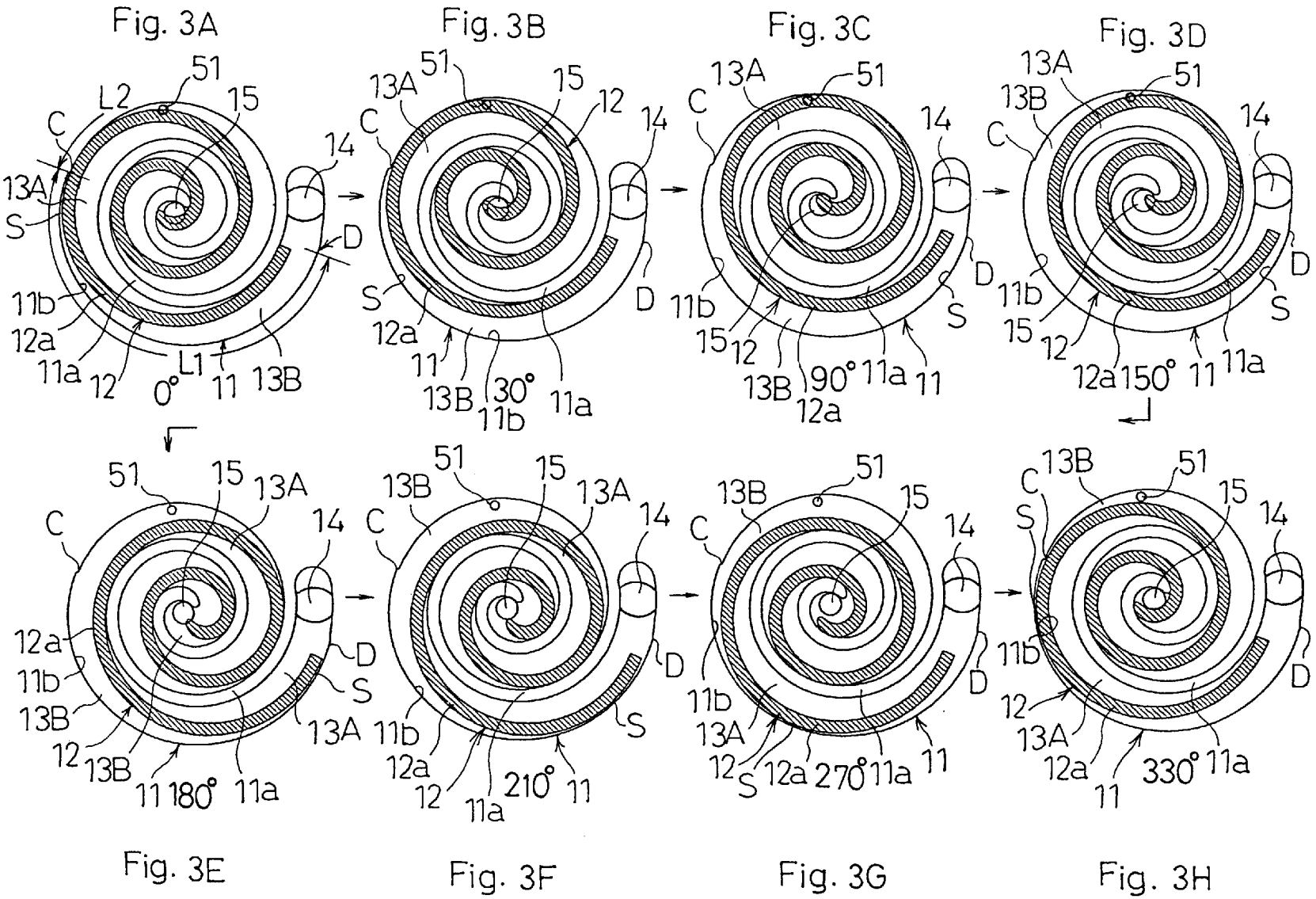

The compressor mechanism 2 comprises the wrap 11*a* of the fixed scroll 11 and the wrap 12*a* of the orbiting scroll 12. The pair of wraps 11*a* and 12*a* are coupled together in the conventional way. Due to the fact that the orbiting scroll 12 which is made not to rotate but to orbit in a circular motion, a pair of compression chambers 13A and 13B will be formed between the fixed scroll 11 and the orbiting scroll 12. The compression is performed by reducing the volume of the compression chambers 13A and 13B while moving them from outer side communicated with an inlet port 14 to inner side where an outlet port 15 is disposed, as shown in FIGS. 1 to 3.

The structure used to support and to drive the compressor mechanism 2 and the guide structure used for sucking in, compressing, and discharging a fluid in the sealed housing 1 is not critical. Additionally, any type of oil pump 6 may be used. The compressor mechanism 2 of this embodiment is constructed by bolting the fixed scroll 11 to the main bearing parts 9 that are attached to one side of the sealed housing 1. The orbiting scroll 12 that is coupled to the fixed scroll 11 is sandwiched between the main bearing parts 9 and the fixed scroll 11. The electric motor 3 comprises a stator 3*a*, the fixed circular element welded to the sealed housing 1 and a rotor 3*b*, the rotating element located inside of the stator 3*a*. The crankshaft 16 is fixed onto the rotor 3*b* in order to drive the orbiting scroll 12 in the compressor mechanism 2.

The crankshaft 16 that is located on one side of the main axis 18 is mounted to the main bearing parts 9 on the main axis side. The other side is attached to an auxiliary bearing 17 which is fixed to the sealed housing 1 by a method such as welding. The auxiliary bearing 17 and the main bearing 9 are connected to the roller bearing 21 and the plain bearing 22, respectively. The main axis 18 is coupled to the rotating axis 12*c*, which extends from the backside of the orbiting scroll 12, on the eccentric position by way of the eccentric bearing 23. The eccentric bearing 23 allows the orbiting scroll 12 to move back and forth on the center line of the main axis 18. Therefore, when the main axis 18 rotates, the orbiting scroll 12 orbits without itself rotating by cooperating with an Oldham ring 28 that is located between the main bearing parts 9 and the orbiting scroll 12. Other variations can be made to this bearing structure. The oil pump 6 is attached to the auxiliary bearing 17.

Because the first embodiment is a scroll compressor for use in refrigeration, the liquid that is being taken in, compressed, and discharged by the compressor mechanism 2 is a refrigerant coolant. Coolants that do not contain chlorine can not be expected to provide any lubrication. However, in the case where a hydrofluorocarbon (HFC) coolant is used, since HFC and the oil 4 are mutually soluble, the coolant can be transported through the oil to the mechanical moving parts inside of the sealed housing 1, thereby enhancing the lubrication.

Inlet port 14 is connected to the gas inlet tube 32, and outlet port 15 is connected to gas outlet tube 34 through the coolant path 33 on top of the oil storage container 5 inside of the sealed housing 1.

The oil pump 6 is powered together with the compressor mechanism 2 by the crankshaft 16. The oil 4 in the storage container 5, which is pumped along the oil path 35 (formed along the crankshaft 16) first supplying the eccentric bearing 23. Part of the oil 4 that is supplied to the eccentric bearing 23 goes through the defined channels and spaces and is supplied to the plain bearing 21 and the compressor mechanism 2. The remained of the oil 4 is returned to the oil storage container 5 located on the bottom of the sealed housing 1.

Furthermore, check valve 42 and check valve guide 43 that regulates the check valve 42 are installed onto the outlet port 15 to prevent the orbiting scroll 12 from rotating in the reverse direction when the compressor mechanism 2 stops.

The condenser 44, the expansion valve 45, the gas/liquid separator 46, the capillary tube 47, and the evaporator 48 are connected in order between the gas outlet tube 34 and the gas inlet tube 32. These components, along with the compressor mechanism 2 in the sealed housing 1 form the loop that completes the refrigeration cycle. In order to make the explanation simpler, a non-heated pump type is shown in the figures, but actually the refrigeration cycle is of the heated pump type, so that it can operate in both the cases of low load air conditioning and high load heating, and the compressor has a switching structure that is not shown in the figures.

Injection port 51 is installed onto the fixed scroll 11 in order to inject the gas into the compression chamber 13. Injection pipe 52 is connected to injection port 51 through check valve 54 and check valve guide 55. This injection pipe 52 is connected to the gas coolant supply tube 53 from the gas/liquid separator 46. Therefore, the gas coolant separated out using the gas/liquid separator 46 passes through the gas coolant supply tube 53, the injection pipe 52, the injection port 51, and is then injected in the compressor chamber 13. The back flow of the injected coolant is stopped by the check valve 54. This kind of gas injection will enhance the compressor efficiency in the compression mechanism 2, thereby increasing the heating ability.

It is best to optimize the gas injection to the various operation states of the refrigeration device. To do this, a bilateral solenoid valve 56 is provided in the middle of the coolant supply tube 53 to either shutoff the gas injection or to resume gas injection, which is controlled together with the operation of the refrigeration device. This control may be done, for example, by a microcomputer together with the operation control of the device; there is no special requirement for it. Further, in addition to the fact that this embodiment is of heated pump type which can be used for both heating and air conditioning, the electrical motor 3 can drive the orbiting scroll 12 under variable rotating speed through an inverter controller to fit the various operation modes.

As shown in FIGS. 3A–H, a pair of compression chambers 13A and 23B are formed between the wrap 11*a* on the fixed scroll 11 and the wrap 12*a* on the orbiting scroll 12. In this embodiment, as one example, an offset surface 11*b* is made on wrap 11*a* of the fixed scroll 11, which enables one of the compression chambers 13B to be opened to an inlet port 14 side with a certain space S. This is important for getting the high injection performance in the case of high load operation under low injection pressure which is the case in the heating operation. At the same time, this ensures the low load operation performance under the gas shutoff condition. The offset surface 11*b* extends from C, the position of spiral length that has to satisfy the compression ratio determined by the compression chamber 13A in the case of low speed operation, to D, the end of the spiral shape.

The orbiting scroll 12 changes its rotation angle from 0° to 330° as shown in FIGS. 3A–H. The 360° position is equivalent to the 0° position. This cycle repeats, such that the inlet, compression, and discharge of coolant occurs, allowing the refrigeration cycle to operate in a cooling or heating mode.

Under low load operation when the speed is low, for example in the cooling operation, one of the compression chambers 13B, which is not sealed due to the space S made by the offset surface 11*b*, out of the pair of compression chambers 13A and 13B that are formed by the fixed scroll 11 and the orbiting scroll 12, does not exhibit the confinement functionality in the area LI that has the space S, since the absorbed coolant can easily escape out through the space S. Because of this, the coolant of which volume is equivalent to the size of the entire compression chamber 13B is not oversupplied, and only in area L2 of compression chamber 13B where there is no space S will it work effectively, and the operation based on the designated confinement volume will obtain a high efficiency. Furthermore, in the area L2 part of compression chamber 13B that does not have the space S and in the other compression chamber 13A, gas injection is not performed. Since the injection port 51 is not opened to the area L2 and to the compression chamber 13A, there is no re-expansion of compressed coolant in the dead volume areas, which include the areas surrounding the injection port 51, such as the check valve 54 and the check valve chamber 57 (see FIGS. 1 and 2). Therefore the performance under low load operation is enhanced.

Figure 4:
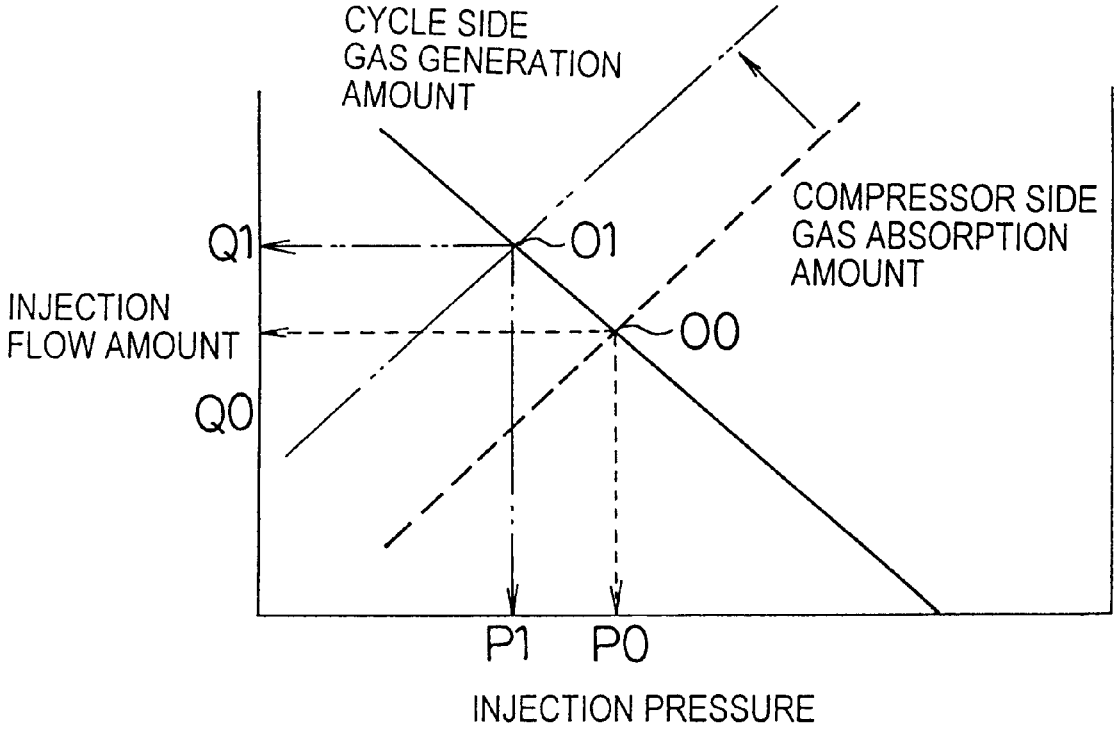
FIG. 4 is a graph showing the equilibrium point of the amount of gas generation on the cycle side and the gas amount absorbed at the compressor side, and the relationship between the injection pressure and the injection flow.

On the other hand, in the case of high load operation, which is the heating operation that involves high speed operation, the compression chamber 13B which has an unsealed area will be oversupplied with coolant of which amount corresponds to the degree of high speed operation relative to the low speed operation, since the space S is small, and the degree of confinement of the absorbed coolant is enhanced as the orbiting scroll 12 orbits at a high speed. Therefore, the amount of coolant absorbed is increased, so that the gas injection is now done using the whole volume of 13B including the area with space S. In FIG. 4, O0 is the standard balance point between the gas generation amount on the cycle side and the gas absorption amount on the compressor side, and P0 is the standard pressure. If O0 is shifted to O1 in the low pressure P1 direction, the injection flow will be shifted to the high flow side of Q1 which is higher than the standard flow Q0. This will maintain a high injection flow and increase the actual amount of coolant discharged sufficiently. This will lead to an enhancement in the performance in the case of high load operation, for example in the case of heating.

Therefore, in Embodiment 1 of this invention, the efficiency of the compressor can be enhanced from the regime of low load operation to high load operation and the power consumption can be reduced. To give an example, favorable results were obtained when the wrap offset was 0.5 mm in width, the offset length was 180° in the rotation angle of the orbiting scroll 12, and the diameter of the injection port 51 was 2.2 mm.

Further, in Embodiment 1 of this invention, the offset surface 11*b* follows the involute form of wrap 11*a*, extending longer than the orbiting scroll 12. This extended length will contribute to the effective area of the compression chamber 13B, in the case of the high speed operation of the orbiting scroll 12. This will further enhance the compressor performance in the high load operation case.

However, it is only necessary to employ this extended part when required. Furthermore the same effect can be achieved without the extension part on wrap 11*a*. The offset surface on wrap 11*a* may be omitted and instead provided on the surface 12*a* of the orbiting scroll 12 to achieve the same effect. Another option is to divide the necessary offset amount into two offset surfaces on the two wraps 11*a* and 12*a* that are opposite to each other.

Furthermore, in Embodiment 1 of this invention, as shown in FIG. 2, inside of the sealed housing l that contains the compressor mechanism 2 and the driving mechanism for the electrical motor 3, there is a muffler 71 installed to cover the outer surfaces where the outlet port 15 of the compressor mechanism 2 is located. The muffler 71 has a through hole 72 that allows the injection pipe 52 which is connected to the injection port 51 to pass therethrough with some positional tolerance. Muffler 71 encloses the coolant discharged from the compressor mechanism 2 into the large area 73 formed by the muffler 71 and the compressor mechanism 2, where the noise is lowered when the coolant is dispersed therein. In addition, the through hole 72, either by itself or in conjunction with other holes that exist in that area, lets the coolant which has been already dispersed and silenced within the muffler 71 to pass therethrough in a controlled manner to a next closed space 74 that is formed between the muffler 71 and the sealed housing 1, functioning as a silencing hole. Due to this, a silencing effect can be improved by taking advantage of the structure of the injection pipe 52.

(Embodiment 2)

Embodiment 2 of this invention shares the same basic structure of Embodiment 1, except that the opening position of the injection port is different. Therefore, the same reference numerals will be used for the same parts, and the repeated figures and explanations will be omitted.

In Embodiment 2 of this invention, as shown in FIGS. 5A–H, the injection port 51 opens alternatively to the unsealed area of the compression chamber 13B and the sealed compression chamber 13A as the rotation angle of the orbiting scroll 12 progresses.

Due to this, gas injection can be performed in both of the compression chambers 13A and 13B. Compared to Embodiment 1, where gas injection is done into one of the compression chambers 13B, not only can the power control regime of the compressor be enhanced, but also the performance of the compressor when it is working under high load operations such as the heating case. In this case, since both of the compression chambers 13A, 13B are working together, the vibration and noise produced from the imbalance in the injection amount will be suppressed. Therefore, a more comfortable degree of operation can be achieved.

Figures 5A, 5B, 5C, 5D, 5E, 5F, 5G, 5H:
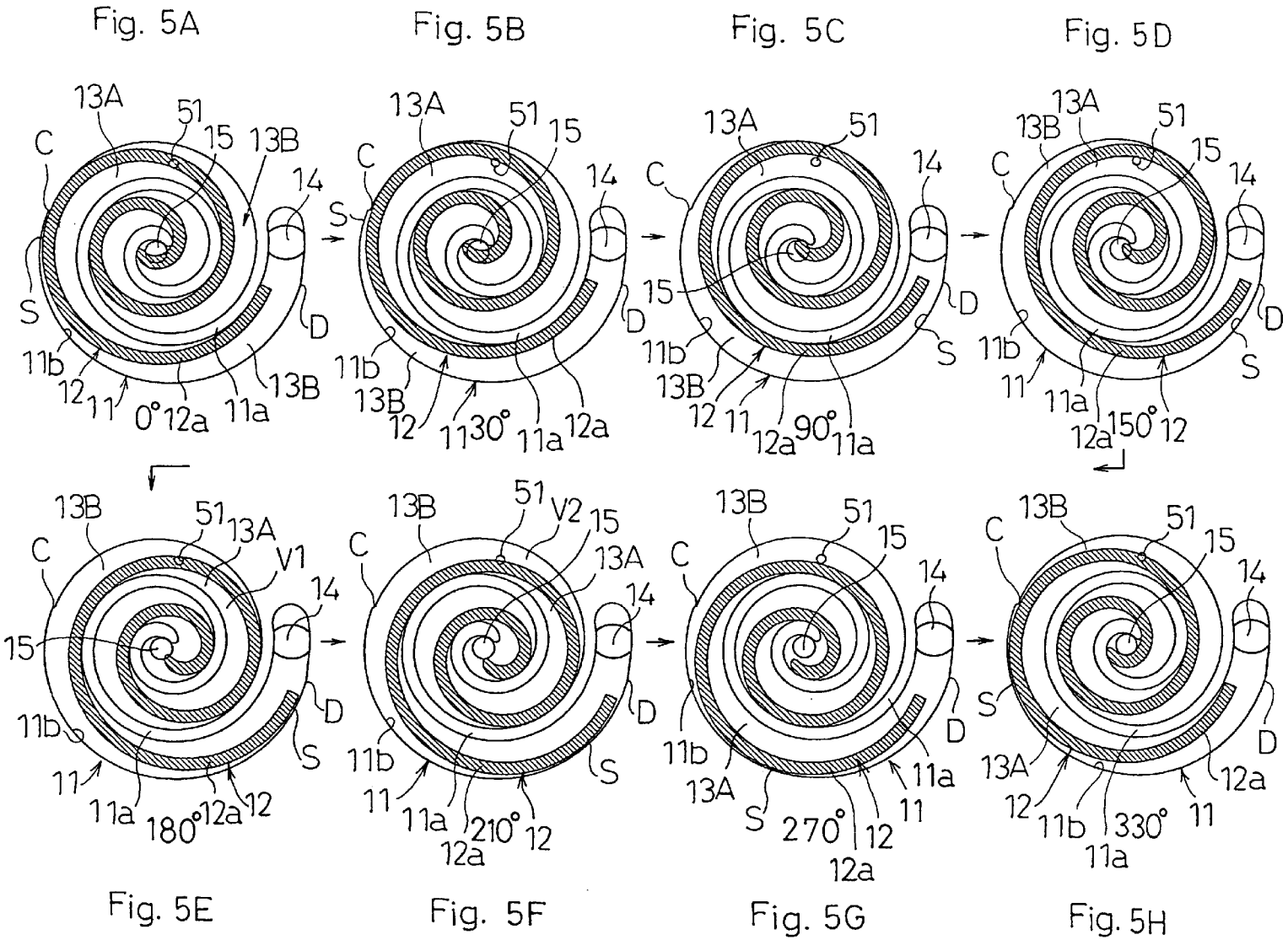

When there is no gas injection, the opening of the injection port 51 will be opened to the sealed compression chamber 13A and in turn to the unsealed area of the compression chamber 13B as the orbiting scroll 12 rotates. When this occurs, the coolant in the dead volume areas surrounding the injection port 51 such as the check valve chamber 57 re-expands. But below a structure which reduces the influence of this re-expansion is discussed. In FIG. 5E, V1 is the volume when the injection port 51 is not opened to the sealed compression chamber 13A. In FIG. 5F, V2 is the volume when injection port 51 is opened to the unsealed area of the compression chamber 13B. In this second embodiment, V2 is designed to be larger than V1. Due to this fact, it is no problem to realize operation without coolant oversupply by not injecting gas in the case of the minimum low load operation or the medium low load operation. At the same time, the compressor efficiency is enhanced from the regime of low load operation to high load operation.

In Embodiment 2 as shown in the progression from the state of FIG. 5E to the FIG. 5F state, the opening of the injection port 51 is located at the position where it starts to communicate with the unsealed area of compression chamber 13B when the coolant is beginning to be confined in compression chamber 13B. By doing this, the volume of the unsealed area of the compression chamber 13B reaches its maximum value when the injection port 51 starts to open to compression chamber 13B. Therefore, the influence of the re-expansion of the coolant in the dead volume areas mentioned above can be suppressed.

Furthermore, as shown in the changes from FIGS. 5A to 5B, the injection port 51 is located at the position where it begins to open to the compression chamber 13A when the compression chamber 13A is just starting the confinement process. By doing this, when the injection port 51 starts to open to the compression chamber 13A, the volume of the sealed compression chamber 13A reaches its maximum value, and the degree of compression reaches its minimum value, so that it is easy to get injection flow using the maximum volume and the lowest pressure. This will again enhance the performance of the compressor in the case of high load operation.

Furthermore, as can be understood from the state changes shown in the sequence of FIGS. 5A, 5B, 5C, 5D, and 5E and the sequence of FIGS. 5E, 5F, 5G, 5H, and 5A, the injection port 51 is located in a position where the opening time to the unsealed area of compression chamber 13B is almost the same as the opening time to compression chamber 13A. Due to this fact, the injection flows to both compression chambers 13A and 13B are almost the same, by which the imbalance in the amount injected to both compression chambers 13A and 13B is eliminated. As an example of this, when the opening angle of the injection port 51 to compression chamber 13A extends from −2° to 163°, the opening angle to compression chamber 13B extends from 78° to 343°, so that the total opening angles of both are 165°, with which a good result is obtained. The remainder of the data on this example is the same as that in Embodiment 1.

(Embodiment 3)

Embodiment 3 of this invention shares the same basic structure of Embodiments 1 and 2, except that the opening position of the injection port is different. Therefore, the same reference numerals will be used for the same parts, and the repeated figures and explanations will be omitted.

Figures 6A, 6B, 6C, 6D, 6E, 6F, 6G, 6H:
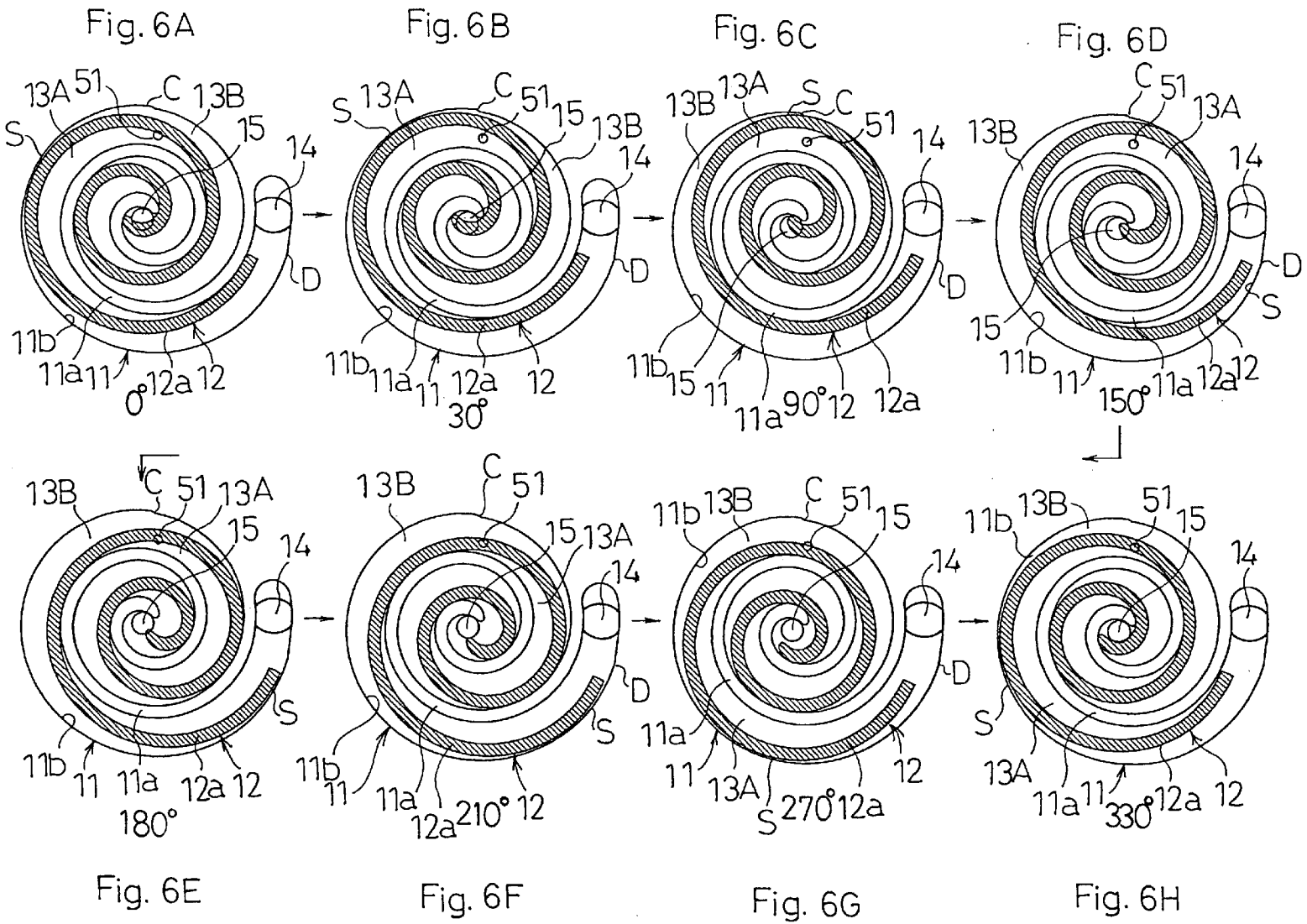

In Embodiment 3, the injection port 51 is situated such that the opening angle thereof with respect to the unsealed compression chamber 13B (as shown in FIGS. 6F to 6G) is smaller than that to the other compression chamber 13A that is sealed (see FIGS. 6H, 6A–6D).

As a result, compared to the situation in Embodiment 1 where gas injection is done in one of the compression chambers 13B, this embodiment exhibits the same result as Embodiment 2 where gas injection is done in both compression chambers 13A and 13B. Since the gas injection can be done into both compression chambers 13A and 13B, the power control regime can be increased, thereby making it easy to apply this to various operation modes. Further, since the amount of flow injected into the unsealed area of compression chamber 13B is smaller than that of compression chamber 13A, the problems related to back flow through the inlet port 14 of the coolant through the space S due to the occurrence of coolant oversupply in the unsealed area of compression chamber 13B can be reduced.

Figure 7:
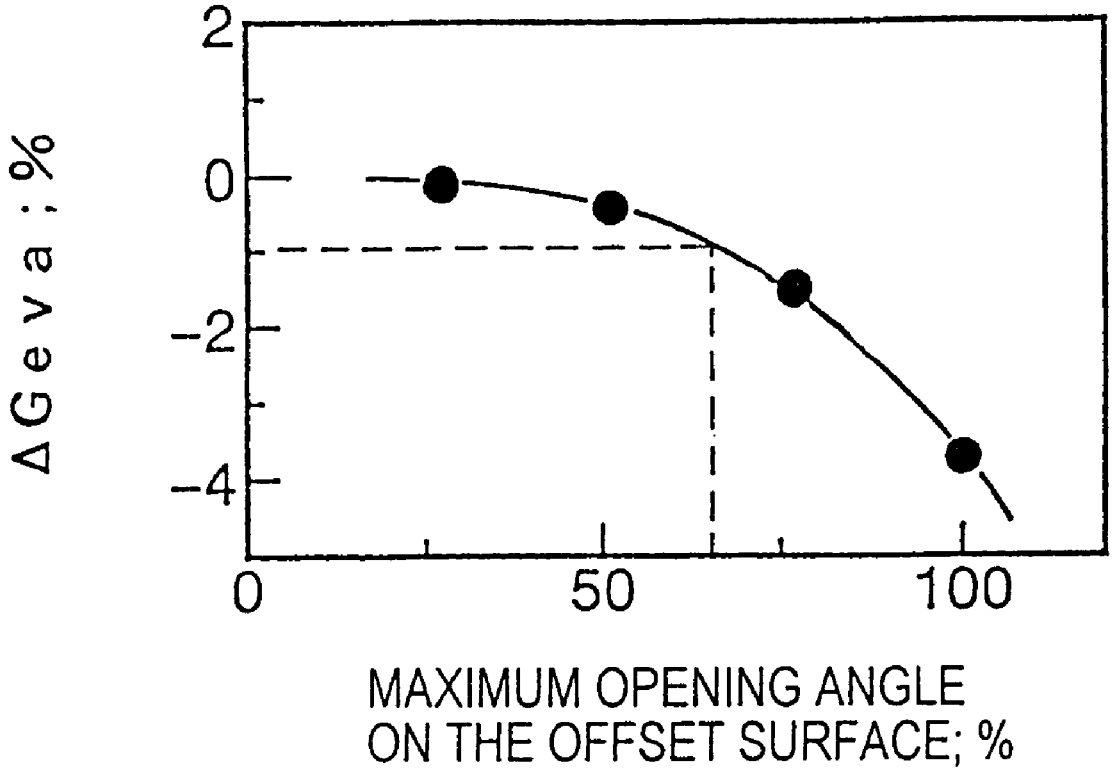
FIG. 7 is a graph illustrating the relationship between the offset of the scroll wraps and the coolant circulation amount at the evaporator side.

In the case of heating, a fixed relationship between the opening angle of the injector port 51 with respect to the unsealed area of one of the compression chambers 13B and the change in the amount of coolant circulation on the evaporator side in the case with no offset surface is as shown in FIG. 7.

It is preferable that the injection port is situated such that the maximum opening angle of the injection port 51 to the unsealed area of the one compression chamber 13B is set so that it is 65% or less of the maximum opening angle to the sealed compression chamber 13A, by which the influence of the injection to the unsealed area of the compression chamber 13B can be sufficiently suppressed.

To give a numerical example of this, when the opening angle of the injection port 51 to the compression chamber 13A extends from −32° to 191°, an opening angle of 223°, shown in the sequence of FIGS. 6H, 6A–6E, the opening angle to compression chamber 13B extends from 210° to 309°, an opening angle of 99°. That is, the maximum opening to the unsealed area of the compression chamber 13B is approximately 44% of that of the maximum opening to the sealed compression chamber 13A, giving a good result. Furthermore, the length of the offset surface 11*b* is 225° of the orbiting angle of the orbiting scroll 12. The remainder of the data for this embodiment is the same as that for Embodiment 1.

However, it is also possible to situate the injection port 51 such that the opening angle to the unsealed area of the compression chamber 13B is larger than that to the sealed compression chamber 13A as necessary.

When this is done, compared to Embodiment 1 where the gas injection is done into one of the compression chambers 13B, the same usage effect can be expected as Embodiments 2 and 3 where gas injection occurs in both of the pair of compression chambers 13A and 13D. Therefore, the coolant back flow problem due to gas injection under low pressure for extended time periods can be overcome, while at the same time ensuring that the amount of flow injected into the unsealed area of the one compression chamber 13B is sufficient and is in balance with the amount of flow injected into the other compression chamber 13A that is sealed. This allows the performance under the high load operation such as heating to be increased.

(Embodiment 4)

Embodiment 4 shares the same basic structure as Embodiments 1 to 3, except that the wrap offset surface and the positioning of the injection port differ. Therefore, the same reference numerals will be used for the parts that are the same, and the repeated figures and explanations will be omitted.

In Embodiment 4, as shown in FIGS. 5A–H, offset surfaces 11*b* and 12*b* are provided in both wraps 11*a* and 12*a* respectively. Each of the offset surfaces 11*b* and 12*b* extends from C1 and D1 to C2 and D2, the edges of the respective wraps. The length from C1/D1 to C2/D2 satisfies the compression ratio of chambers 13A and 13B defined by the required low speed operation condition. The offset surfaces 11*b* and 12*b* allow the pair of compression chambers 13A, 13B to open to the inlet port 14 side with a predetermined space S so that the compression chambers 13A and 13B will not be sealed.

Figures 8A, 8B, 8C, 8D, 8E, 8F, 8G, 8H:
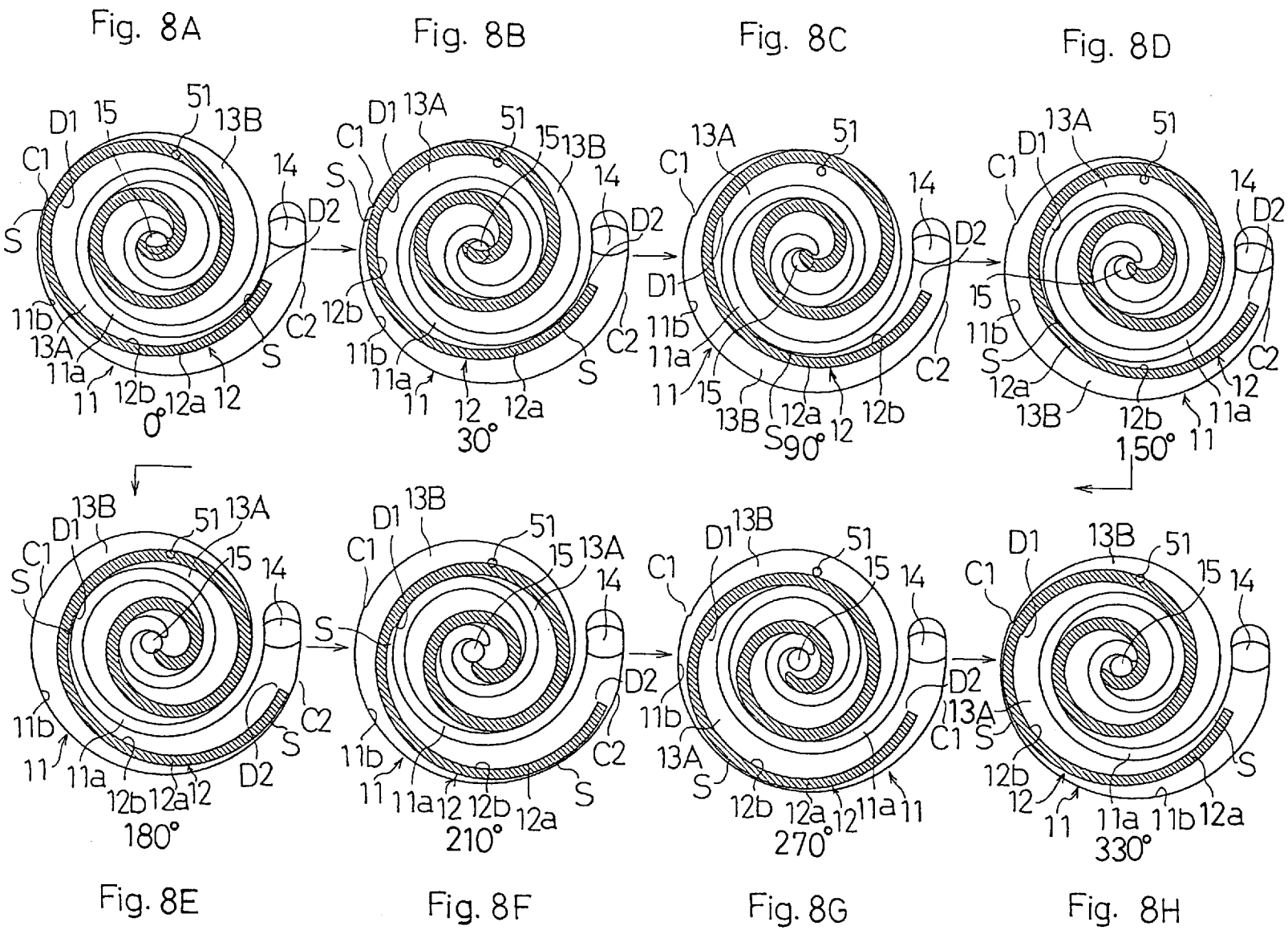

The orbiting scroll 12, following FIGS. 8A–H, rotates from 0° to 330° and then returns to 360° shown in FIG. 8A. By repeating this cycle, coolant is absorbed, compressed, and then discharged. The refrigeration cycle operates according to the required air conditioning or heating mode.

In the case of the low load operation which is low speed operation, for example in the air conditioning operation mode, the absorbed coolant in the compression chambers 13A and 13B can easily escape to the outside through the space S which is created by respective offset surfaces 11*b* and 12*b*, even if the space S is very small. This ability of coolant to escape disables the confinement functionality of the compression chambers in the area where the offsets 11*b* and 12*b* are located. Therefore, the coolant of which volume corresponds to the entire volume of compression chambers 13A and 13B will not be oversupplied. Only in the areas of compression chambers 13A and 13B where the offset surfaces 11*b* and 12*b* do not exist does the coolant work efficiently. Therefore, a high efficiency as calculated based on the confinement volume in the case of the required low speed operation can be achieved. Furthermore, since gas injection is not performed in the part of the compression chambers 13A and 13B where the offset surfaces 11*b* and 12*b* are not located, and thus the injection port 51 is not opened to these parts, the coolant re-expansion caused by the compression in the dead volume areas around injection port 51 that include the check valve chamber 57 and the check valve 54 does not occur. Therefore, the compressor performance can be enhanced under low load operation conditions.

Figure 9:
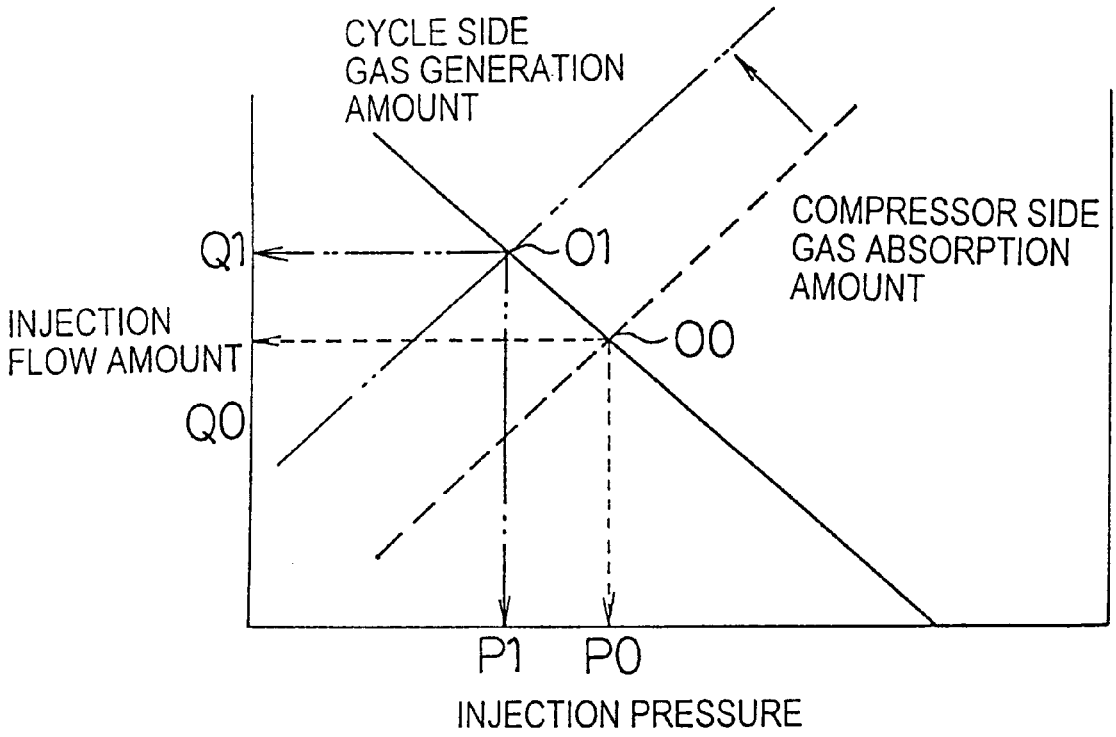
FIG. 9 is a graph showing the equilibrium point of the amount of gas generation on the cycle side and the gas amount absorbed at the compressor side, and the relationship between the injection pressure and the injection flow.

On the other hand, in the high load operating condition when the speed is high, such as in the heating operation mode, the pair of compression chambers 13A, 13B which have the unsealed areas increase their ability to confine absorbed coolant due to the fact that the space S is small and the orbiting scroll 12 rotates at a high speed. Accordingly, the amount of absorbed coolant increases, and the coolant will be oversupplied according to the degree of high speed operation in comparison to the low speed operation. Further, due to the low pressure gas injection that uses the entire volume of the compression chambers 13A and 13B that have a large volume including the areas that have the offset surfaces 11*b* and 12*b*, as shown in FIG. 9, if the standard balance point O0 between the gas amount generated on the cycle side and the amount of gas absorbed on the compressor side is shifted to O1 from the standard pressure P0 to an even lower pressure P1, the injection flow amount shifts from the standard flow amount Q0 to an even larger flow amount Q1. This ensures a high injection flow amount, and the actual coolant outlet amount is sufficiently increased. Due to this, the performance in the high load operation condition such as heating is increased.

Therefore, in Embodiment 4, the compressor efficiency is improved from the low load operation regime to the high load operation regime, and the yearly power consumption can be decreased. Additionally, the power control window can be enlarged due to the fact that a high effective volume ratio of high power operation under high speed to low power operation under low speed can be obtained. This will enhance the versatility of the compression in various applications. Furthermore, since the gas injection is done into both compression chambers 13A and 13B, the vibration and noise that are generated due to an imbalance in the amount of injection can be controlled, and the operation comfort is improved.

Further, in Embodiment 4 of the present invention, as shown in FIGS. 8A through 8B and 8E through 8F, the injection port 51 is situated such that it begins to open to the unsealed areas of compression chambers 13A and 13B from the point in time when each of the compression chambers 13A and 13B begins the confinement of coolant. By this, when the injection port 51 begins to open to the compression chamber, the volume of the unsealed area reaches its maximum value, and therefore the influence of the re-expansion of the coolant in the dead volumes can be minimized.

As can be understood from the state changes from FIGS. 8A, 8B, 8C, 8D, and 8E, and the changes shown in FIGS. 8E, 8F, 8G, 8H, and 8A, injection port 51 is opened to both of the unsealed areas of compression chambers 13A and 13B for approximately the same amount of time. This means that the amount of coolant injected into each of the compression chambers 13A and 13B is almost the same, leading to an elimination of the imbalance in the coolant supply to the compression chambers 13A and 13B, improving the operational comfort.

To give a numerical example, good results were obtained when each offset surface 11*b* and 12*b* had an offset amount 0.5 mm, the offset length was 180° of the orbiting angle of the orbiting scroll 12, the injection port 51 had a diameter of 2.2 mm, and the injection port 51 opened to the compression chamber 13A from −2° to 163°, and opened to the compression chamber 13B from 178° to 343°, both equaling an opening angle of 165°.

Also, Embodiment 4 of this invention is similar to Embodiment 1 in that the offset surface 11*b* lies along the involute shape of the wrap of 11*a*, and extends even longer than the orbiting scroll 12. The function of this extended length is as described in Embodiment 1.

However, it is not necessary to always have this kind of extended part, only when it is applicable to the situation.

Likewise, the offset surface 12*b* can be eliminated and the offset can be applied to the other wrap 11*a*. Further, for both of the offset surfaces 11*b* and 12*b*, even if the necessary offset amount is divided between the surfaces of the wraps 11*a* and 12*a* that are facing each other, the same performance can be obtained.

(Embodiment 5)

Embodiment 5 of this invention shares the basic structure as Embodiment 4 of this invention, except that the injection port opening position is different. Therefore, the same reference numerals will be used for the same parts, and the repeated figures and explanations will be omitted.

Figures 10A, 10B, 10C, 10D, 10E, 10F, 10G, 10H:
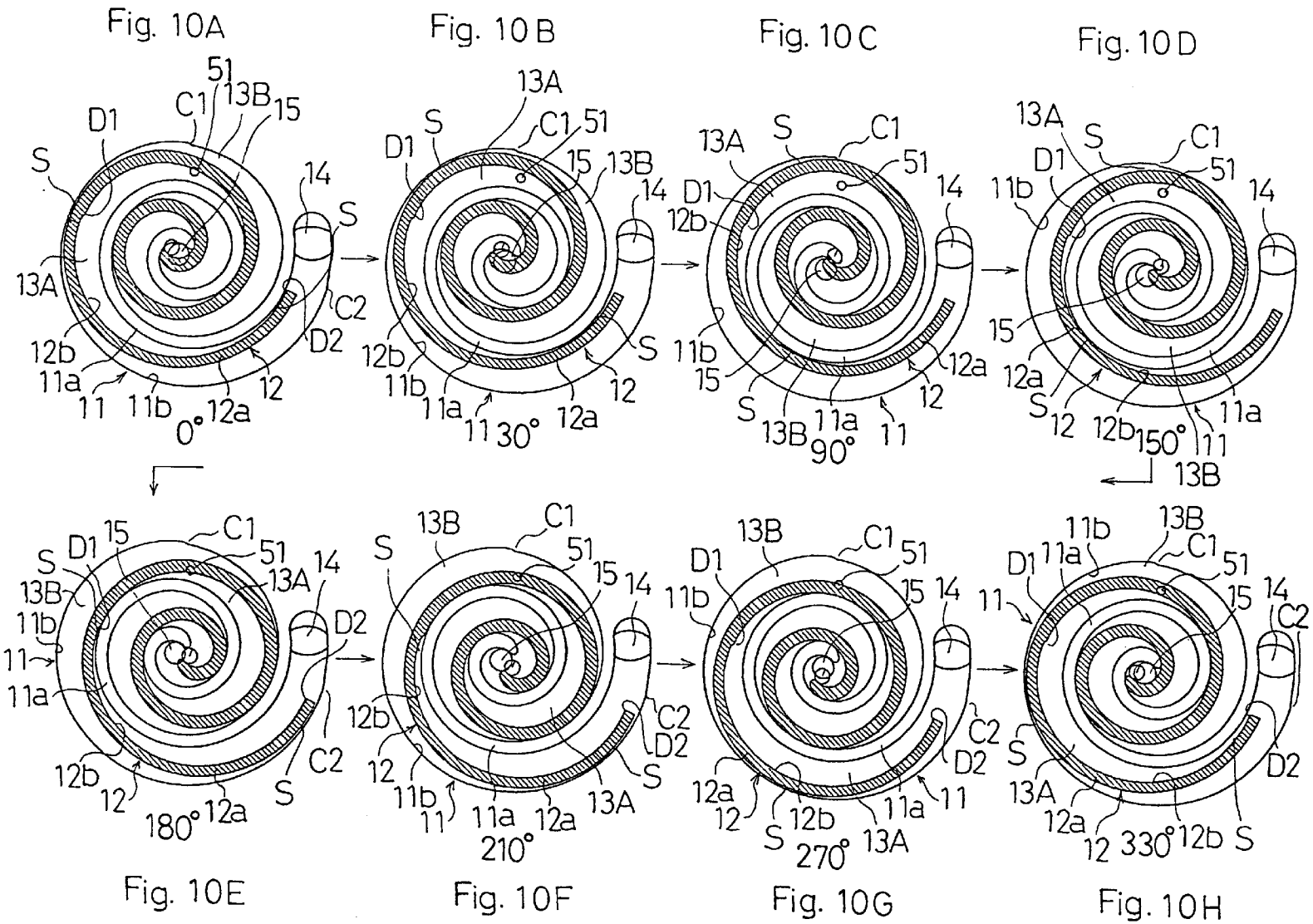

In Embodiment 5 of this invention, the injection port 51 is positioned such that its opening angle to the compression chamber 13B, as shown through FIGS. 10F to 10G is smaller than its opening to compression chamber 13A, shown through FIGS. 10H and 10A to 10E.

Further, the offset surface 11*b* of one of the compression chambers 13B is formed larger than that in the case of Embodiment 4, so that the minimum operation power is further reduced to suit the case of low speed operation, therefore increasing the control regime. Furthermore, by making the opening area and the opening time of injection port 51 to the compression chamber 13B smaller, thereby reducing the injection flow amount, it is easy to suppress the back flow of the injected gas owing to the extension of the offset surface 11*b*, so that any reduction in the injection performance due to coolant back flow is prevented.

In the heating operation, there is a fixed relationship between the opening angle of the injection port 51 to the unsealed area of the compression chamber 13B created by the offset surface 11*b* and the change in the coolant circulation amount on the evaporator side in the case of no offset surface as described above with reference to FIG. 7. In this embodiment, it is also preferable if the injection port 51 is situated such that the maximum degree of opening of the injection port 51 to one compression chamber 13B which is unsealed due to the large area of the offset surface 11*b* is 65% or less of the maximum degree of opening of the injection port 51 to the other compression chamber 13A which is unsealed with its smaller offset surface 12*b*, so as to sufficiently suppress the influence of the injection gas back flow.

To give a numerical example of this, the opening angle of injection port 51 to compression chamber 13A (shown in the order of FIG. 10H, and then FIGS. 10A through 10E), is 223° from −32° to 191°, and the opening to compression chamber 13B is 99° from 210° to 309°. Therefore the maximum opening angle to the unsealed area of the one compression chamber 13B is 44% of the maximum opening to the other compression chamber 13A that is sealed, allowing a good result to be achieved. Furthermore, the length of the offset surface 11*b* is 255° of the orbiting angle. The remainder of the data for this case is the same as for Embodiment 1 of the present invention.

(Embodiment 6)

Embodiment 6 of this invention shares the same basic structure as Embodiment 4 of the present invention, with the relationship of the opening angle of the injection port to the pair of compression chambers reversed from that of Embodiment 5. Therefore, the explanation will refer to the figures and symbols used in Embodiment 4 of the present invention.

In this embodiment, the injection port 51 is situated such that the opening angle of the injection port 51 to the unsealed area of one of the compression chambers 13B is larger than that to the other compression chamber 13A. By doing this, the back flow of unsealed coolant can be suppressed due to the long amount of time that gas injection is performed in one of the compression chambers 13B under low pressure, while obtaining a sufficient amount of injection. This will further enhance the performance of the compressor at high load operating conditions, such as the heating condition.

While a preferred embodiment of the invention has been described using specific terms, such description is for illustrative purposes only, and it is to be understood that changes and variations may be made without departing from the spirit or scope of the following claims.

What is claimed is:

1. A scroll compressor which performs gas injection through an injection port into compression chambers formed between a fixed scroll and an orbiting scroll which is made to orbitally move in relation to the fixed scroll at a variable speed, comprising:

wraps provided to the fixed scroll and the orbiting scroll, respectively, for forming a pair of compression chambers therebetween;

an offset surface provided in the wrap so as to open one of the compression chambers to an inlet port side with a prescribed space, said offset surface extending on the wrap from a position on a spiral length that satisfies a required compression ratio for one of the pair of compression chambers in a prescribed low speed operation to an end of the spiral of the wrap; and a control means for timely shutting off and resuming gas injection; wherein the injection port is positioned such as to open to an unsealed area in one of the pair of compression chambers, said unsealed area being created by said offset surface.

2. The scroll compressor according to claim 1, further comprising a muffler which is mounted inside of a sealed housing, in which a compressor mechanism and a driving mechanism thereof are encased, and covers an outer side of the compressor mechanism where an outlet port thereof is disposed, said muffler including a through hole, through which an injection pipe that is further connected to the injection port is passed with positional tolerance.

3. A scroll compressor which performs gas injection through an injection port into compression chambers formed between a fixed scroll and an orbiting scroll which is made to orbitally move in relation to the fixed scroll at a variable speed, comprising:

wraps provided to the fixed scroll and the orbiting scroll, respectively, for forming a pair of compression chambers therebetween;

an offset surface provided in the wrap so as to open one of the compression chambers to an inlet port side with a prescribed space, said offset surface extending on the wrap from a position on a spiral length that satisfies a required compression ratio for one of the pair of compression chambers in a prescribed low speed operation to an end of the spiral of the wrap; and a control means for timely shutting off and resuming gas injection; wherein the injection port is positioned such as to open sequentially to an unsealed area in one of the pair of compression chambers, said unsealed area being created by said offset surface, and in turn to the other compression chamber that does not have an offset surface and thus is sealed.

4. The scroll compressor according to claim 3 wherein the injection port is positioned such as to start to open to the unsealed area of one of the compression chambers from a point in time when said one compression chamber begins confinement of a coolant.

5. The scroll compressor according to claim 3, wherein the injection port is positioned such as to start to open to the sealed other compression chamber from a point in time when said other compression chamber begins confinement of a coolant.

6. The scroll compressor according to claim 3, wherein the injection port is positioned such as to open to the unsealed area of one of the compression chambers and to the other compression chamber that is sealed for approximately the same amount of time.

7. The scroll compressor according to claim 3 wherein an opening angle of the injection port to the unsealed area in one of the pair of compression chambers is smaller than the opening angle of the injection port to the other compression chamber that does not have the offset surface and thus is sealed.

8. The scroll compressor according to claim 7, wherein a maximum opening angle of the injection port to the unsealed area of one of the compression chambers is less than 65% of a maximum opening angle of the injection port to the other compression chamber that is sealed.

9. The scroll compressor according to claim 3 wherein an opening angle of the injection port to the unsealed area in one of the pair of compression chambers is larger than the opening angle of the injection port to the other compression chamber that does not have the offset surface and thus is sealed.

10. A scroll compressor which performs gas injection through an injection port into compression chambers formed between a fixed scroll and an orbiting scroll which is made to orbitally move in relation to the fixed scroll at a variable speed, comprising:

wraps provided to the fixed scroll and the orbiting scroll, respectively, for forming a pair of compression chambers therebetween;

offset surfaces provided in both wraps so as to open respective compression chambers to an inlet port side with a prescribed space, said offset surfaces extending on the wraps from a position on a spiral length that satisfies a required compression ratio for the pair of the compression chambers in a prescribed low speed operation to respective ends of the spiral of the wraps; and a control means for timely shutting off and resuming gas injection; wherein the injection port is positioned such as to open sequentially to unsealed areas of each of the pair of compression chambers, said unsealed areas being created by said respective offset surfaces in both wraps.

11. The scroll compressor according to claim 10, wherein the injection port is positioned such as to start to open to the unsealed area of at least one of the compression chambers just as said one compression chamber begins confinement of a coolant.

12. The scroll compressor according to claim 10, wherein the injection port is positioned such as to open to each of the compression chambers for approximately the same amount of time.

13. The scroll compressor according to claim 10 wherein the opening angle of the injection port to the unsealed area of one of the pair of the compression chambers is smaller than the opening angle of the injection port to the other compression chamber.

14. The scroll compressor according to claim 13, wherein a maximum opening angle of the injection port to the unsealed area of one of the compression chambers is less than 65% of a maximum opening angle of the injection port to the unsealed area of the other compression chamber.

15. The scroll compressor according to claim 10 wherein the opening angle of the injection port to the unsealed area of one of the pair of the compression chambers is larger than the opening angle of the injection port to the other compression chamber.

16. The scroll compressor according to claim 15, further comprising a muffler which is mounted inside of a sealed housing, in which a compressor mechanism and a driving mechanism thereof are encased, and covers an outer side of the compressor mechanism where an outlet port thereof is disposed, said muffler including a through hole, through which an injection pipe that is further connected to the injection port is passed with positional tolerance.

* * * * *